US011339459B2

(12) United States Patent
Kong et al.

(10) Patent No.: US 11,339,459 B2
(45) Date of Patent: May 24, 2022

(54) GOLD-COLORED STEEL SHEET AND MANUFACTURING METHOD THEREOF

(71) Applicant: POSCO, Pohang-si (KR)

(72) Inventors: Jung-Hyun Kong, Pohang-si (KR); Sang Seok Kim, Pohang-si (KR); Mi Nam Park, Pohang-si (KR)

(73) Assignee: POSCO, Pohang-si (KR)

( * ) Notice: Subject to any disclaimer, the term of this patent is extended or adjusted under 35 U.S.C. 154(b) by 175 days.

(21) Appl. No.: 16/473,030

(22) PCT Filed: May 15, 2017

(86) PCT No.: PCT/KR2017/004993
§ 371 (c)(1),
(2) Date: Jun. 24, 2019

(87) PCT Pub. No.: WO2018/117346
PCT Pub. Date: Jun. 28, 2018

(65) Prior Publication Data

US 2020/0095656 A1 Mar. 26, 2020

(30) Foreign Application Priority Data

Dec. 23, 2016 (KR) ..... 10-2016-0178323

(51) Int. Cl.
*C22C 38/00* (2006.01)
*C21D 8/02* (2006.01)
(Continued)

(52) U.S. Cl.
CPC ..... *C22C 38/001* (2013.01); *C21D 8/0257* (2013.01); *C21D 9/46* (2013.01);
(Continued)

(58) Field of Classification Search
CPC ..... C23C 8/26; C22C 38/50; C22C 38/04; C22C 38/48; C22C 38/02; C22C 38/001;
(Continued)

(56) References Cited

FOREIGN PATENT DOCUMENTS

JP H03-37846 B2 6/1991
JP H05-025636 A 2/1993
(Continued)

OTHER PUBLICATIONS

English abstract and English Machine Translation of Hattori et al. (JP 05-025636) (dated Feb. 2, 1993).*
(Continued)

*Primary Examiner* — Jessee R Roe
(74) *Attorney, Agent, or Firm* — Morgan, Lewis & Bockius LLP

(57) ABSTRACT

The present invention discloses a gold-colored steel sheet capable of expressing color without peeling of a modified layer and the gold-colored steel sheet capable of forming a color-modified layer through a conventional annealing process without expensive facilities.

A method of manufacturing the gold-colored steel sheet according to an embodiment of the present invention can form a TiN modified layer on a surface of a steel sheet comprising 0.3 to 1.5 wt % of titanium (Ti) by an annealing treatment in a nitrogen ($N_2$) atmosphere at 900 to 1,200° C. for 30 to 300 seconds.

6 Claims, 6 Drawing Sheets

(51) Int. Cl.

| | |
|---|---|
| ***C21D 9/46*** | (2006.01) |
| ***C22C 38/02*** | (2006.01) |
| ***C22C 38/04*** | (2006.01) |
| ***C22C 38/48*** | (2006.01) |
| ***C22C 38/50*** | (2006.01) |

(52) U.S. Cl.
CPC ..... *C22C 38/02* (2013.01); *C22C 38/04* (2013.01); *C22C 38/48* (2013.01); *C22C 38/50* (2013.01); *C21D 2201/00* (2013.01)

(58) Field of Classification Search
CPC ..... C21D 3/08; C21D 8/0278; C21D 8/0257; C21D 9/46
See application file for complete search history.

(56) References Cited

FOREIGN PATENT DOCUMENTS

| | | | |
|---|---|---|---|
| JP | 2005-264213 | A | 9/2005 |
| JP | 2006-233282 | A | 9/2006 |
| KR | 10-2002-0042151 | A | 6/2002 |
| KR | 2002-0042151 | A | 6/2002 |
| KR | 10-2002-0052737 | A | 7/2002 |
| KR | 10-0515939 | B1 | 9/2005 |
| KR | 10-1350156 | B1 | 1/2014 |

OTHER PUBLICATIONS

Chinese Office Action dated Feb. 7, 2021 issued in Chinese Patent Application No. 201780084379.0 (with English translation).
Japanese Office Action dated Feb. 25, 2021 issued in Japanese Patent Application No. 2019-534642 (with English translation).
International Search Report issued in corresponding International Patent Application No. PCT/KR2017/004993 dated Aug. 18, 2017.
Japanese Office Action dated Jun. 2, 2020 issued in Japanese Patent Application No. 2019-534642 (with English translation).
Chinese Office Action dated Jul. 22, 2020 issued in Chinese Patent Application No. 201780084379.0 (with English translation).
Extended European Search Report dated Oct. 1, 2019 issued in European Patent Application No. 17885227.3.
Japanese Office Action dated Sep. 7, 2021 issued in Japanese Patent Application No. 2019-534642 (with English translation).

* cited by examiner

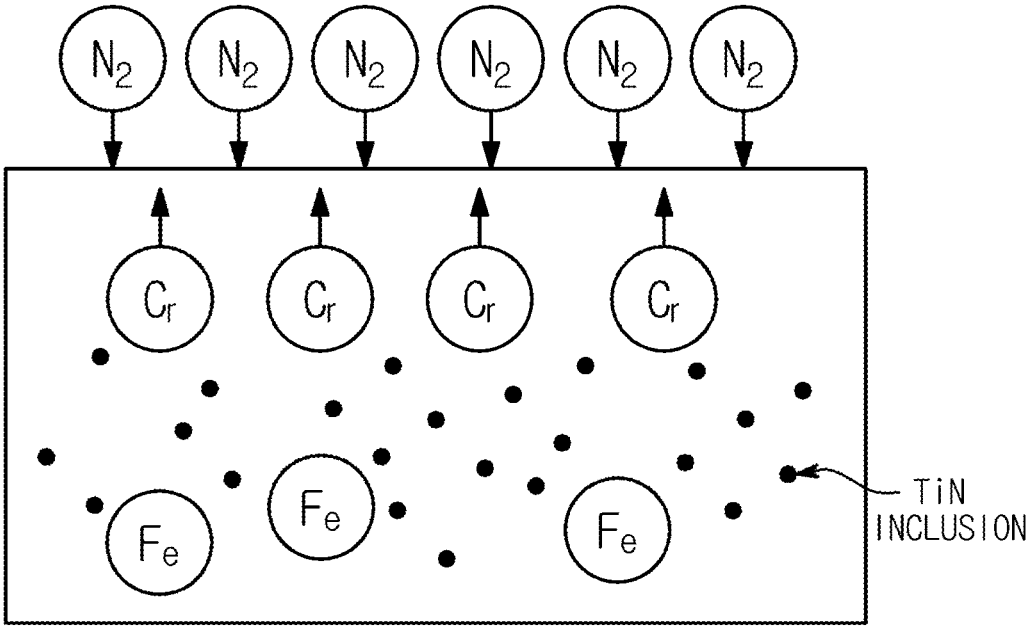
【FIG. 1】

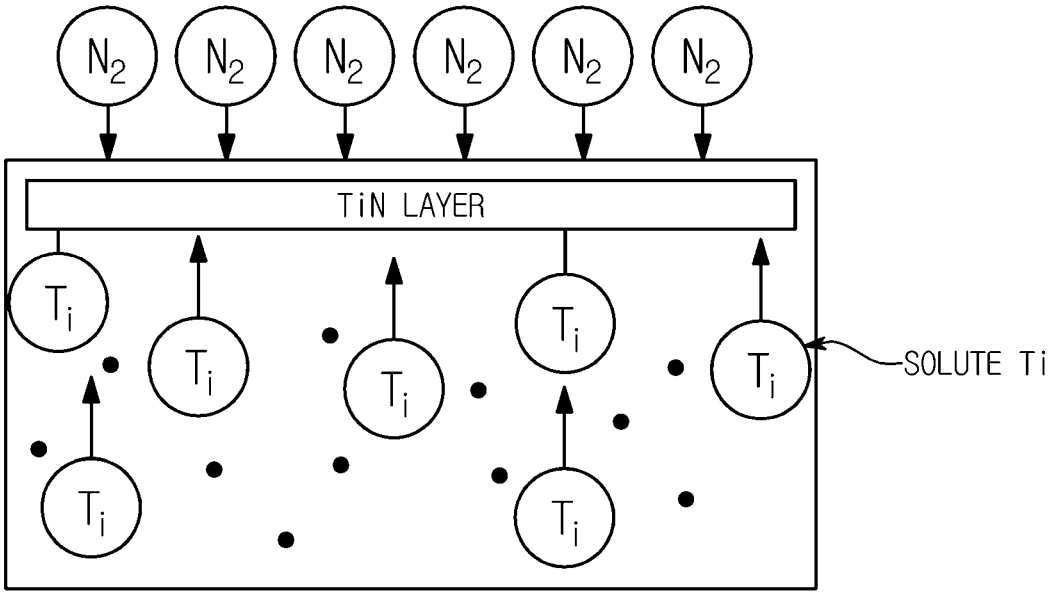
【FIG. 2】

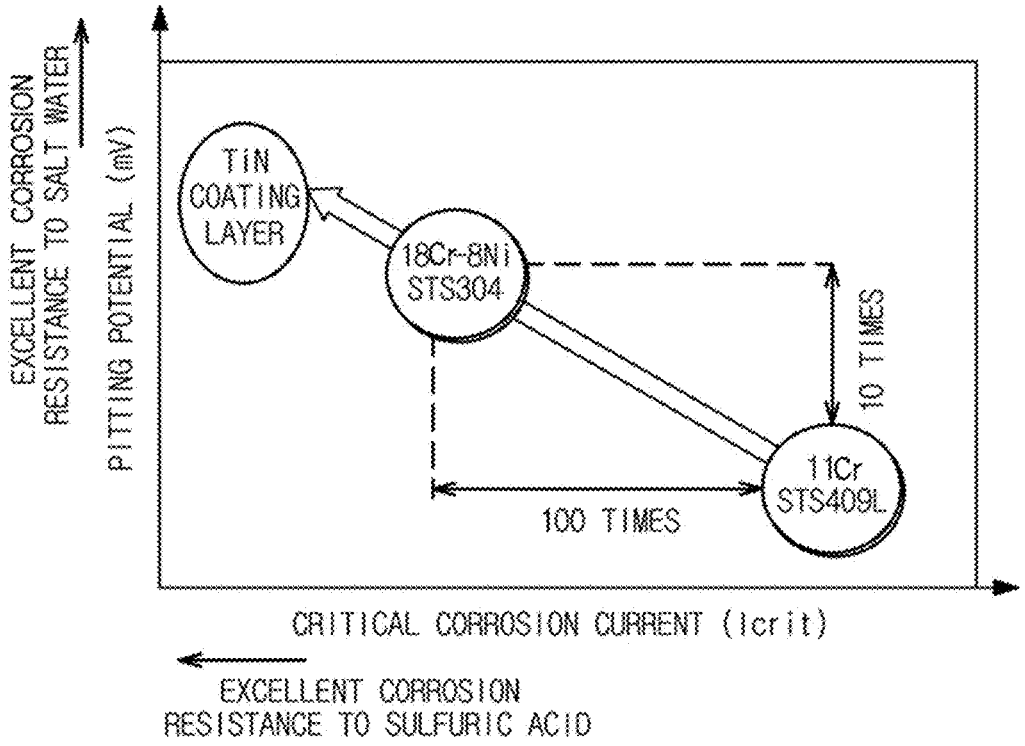
【FIG. 3】

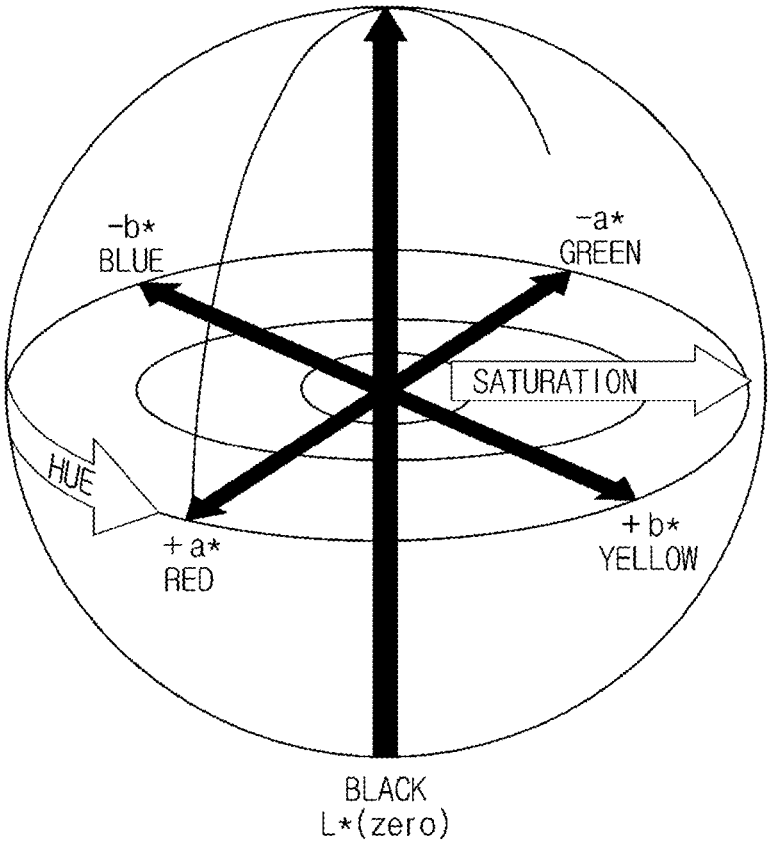
【FIG. 4】

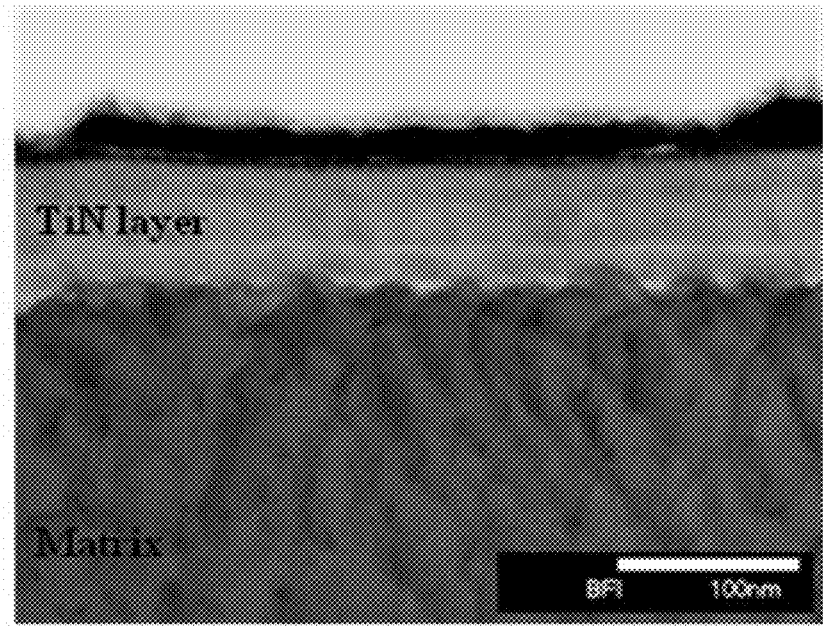
【FIG. 5】

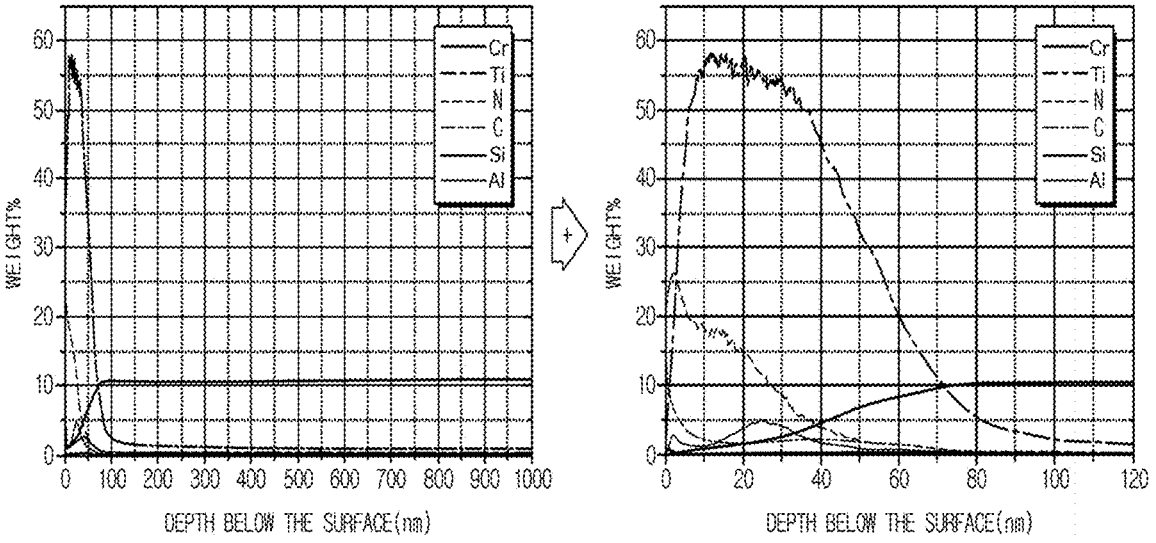
【FIG. 6】

GOLD-COLORED STEEL SHEET AND MANUFACTURING METHOD THEREOF

CROSS-REFERENCE OF RELATED APPLICATIONS

This application is the U.S. National Phase under 35 U.S.C. § 371 of International Patent Application No. PCT/KR2017/004993, filed on May 15, 2017, which in turn claims the benefit of Korean Application No. 10-2016-0178323, filed on Dec. 23, 2016, the entire disclosures of which applications are incorporated by reference herein.

TECHNICAL FIELD

The present invention relates to a colored-steel sheet and method for modifying a surface thereof, more particularly, to a gold-colored steel sheet capable of forming a TiN modified layer through a conventional annealing process of a stainless steel including titanium (Ti) to express an aesthetic gold color on a surface of a steel sheet, and a method of manufacturing the same.

BACKGROUND ART

In modern society, there is an increasing desire to create various aesthetics in life by using colors, and this is also the case with steel sheets such as stainless steel which are widely used in daily necessities, housewares and office supplies.

Various methods such as painting, anodizing, electroplating (ECD), diffusion coating, thermal spraying, and enamel coating have been developed for decorative coatings. Chemical and physical vapor deposition (CVD and PVD) methods are mainly used as a color forming method for stainless steel.

The CVD method is a metal deposition method using chemical vapor. A steel sheet is exposed to the vapor of metal compound and maintained at a high temperature in a plating chamber together with a transport gas to deposit metal by pyrolyzing a surface. The PVD method is also referred to as dry plating, in which a metal is vaporized in a vacuum and deposited on a steel sheet, which can be classified into vacuum deposition, sputtering, and ion plating. The PVD method is capable of plating a high melting point material such as titanium, and when a nonmetal atom is ionized and reacted in a vacuum, a compound coating such as titanium nitride (TiN) can be plated to be mainly used for color expression of the steel sheet.

Such deposition methods are not possible without a special vacuum and sputtering apparatuses, and there is a problem that high costs are incurred in the process. Also, a peeling phenomenon caused by the low adhesion between a base material and a modified layer deposited on a surface of the base material is also pointed out as a problem.

(Patent Document 1) Korean Patent Laid-Open Publication No. 10-2011-0104631 (published on Sep. 23, 2011)

DISCLOSURE

Technical Problem

The present invention provides a gold-colored steel sheet capable of expressing color without a peeling phenomenon of a modified layer, and a method of manufacturing the gold-colored steel sheet capable of forming a color-modified layer through a conventional annealing process without expensive facilities.

Technical Solution

The gold-colored steel sheet according to an embodiment of the present invention may be a steel sheet including a base material and a modified layer provided on an outermost surface layer of the base material, wherein the modified layer may be a TiN modified layer including 30 wt % or more of Ti and 10 wt % or more of N, and wherein alloy element contents in the TiN modified layer satisfy the following formula (1).

$$0.1\text{ wt }\% \leq C+Si+Al+Mn+Cr+Ni+Nb+Zr \leq 35.0\text{ wt }\% \quad (1)$$

Here, C, Si, Al, Mn, Cr, Ni, Nb and Zr mean the content (wt %) of each element.

Also, according to an embodiment of the present invention, the b* value of an L*a*b* color system of a surface of the TiN modified layer may be 25 or more.

Also, according to an embodiment of the present invention, the base material may include 0.003 wt % or less of N and 0.015 wt % or less of C+N.

Also, according to an embodiment of the present invention, the TiN modified layer may have a thickness of 10 nm or more.

Also, according to an embodiment of the present invention, the TiN modified layer may have a thickness of 20 to 120 nm.

Also, according to an embodiment of the present invention, the gold-colored steel sheet may have a pitting potential of 300 mV or more.

A method for manufacturing a gold-colored steel sheet according to an embodiment of the present invention may include forming a TiN modified layer on a surface of a steel sheet including 0.3 to 1.5 wt % of titanium (Ti) by an annealing treatment in a nitrogen ($N_2$) atmosphere, wherein alloy element contents in the TiN modified layer may satisfy the following formula (1).

$$0.1\text{ wt }\% \leq C+Si+Al+Mn+Cr+Ni+Nb+Zr \leq 35.0\text{ wt }\% \quad (1)$$

Here, C, Si, Al, Mn, Cr, Ni, Nb and Zr mean the content (wt %) of each element.

Also, according to an embodiment of the present invention, the annealing treatment may be a continuous bright annealing treatment.

Also, according to an embodiment of the present invention, the annealing treatment may be performed at 900 to 1,200° C. for 30 to 300 seconds.

Also, according to an embodiment of the present invention, the steel sheet may include 0.003 wt % or less of N.

Also, according to an embodiment of the present invention, the steel sheet may include 0.015 wt % or less of C+N.

Advantageous Effects

The method of manufacturing a gold-colored steel sheet according to the present invention is economical because it can form a color-modified layer through a conventional annealing process without expensive facilities. Also, a modified layer can be formed by the reaction through diffusion of titanium (Ti) and nitrogen (N), which is enriched from the inside into a surface of a material, so that the gold-colored steel sheet free from a peeling phenomenon can be produced.

Also, a steel sheet produced according to the present invention can express an aesthetic gold color having a b* value of 25 or more of an L*a*b* color system.

Also, the TiN modified layer of the steel sheet produced according to the present invention has a high pitting potential having excellent corrosion resistance.

DESCRIPTION OF DRAWINGS

FIG. 1 is a schematic diagram showing the behavior of titanium and nitrogen in normal steel.

FIG. 2 is a schematic diagram showing the behavior of titanium and nitrogen according to the present invention.

FIG. 3 is a graph showing the corrosion resistance of a TiN modified layer.

FIG. 4 is a schematic diagram of a COLOR SPACE showing an L*a*b* color system.

FIG. 5 is a photograph of the TiN modified layer of an outermost surface layer taken by the FIB-TEM technique.

FIG. 6 is a graph showing alloy element behavior of an outermost surface layer.

BEST MODE

The gold-colored steel sheet according to an embodiment of the present invention is a steel sheet comprising a base material and a modified layer provided on an outermost surface layer of the base material, wherein the modified layer is a TiN modified layer comprising 30 wt % or more of Ti and 10 wt % or more of N, and wherein alloy element contents in the TiN modified layer satisfy the following formula (1).

$$0.1\text{ wt }\% \leq C+Si+Al+Mn+Cr+Ni+Nb+Zr \leq 35.0\text{ wt }\% \quad (1)$$

Here, C, Si, Al, Mn, Cr, Ni, Nb and Zr mean the content (wt %) of each element.

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

The method for manufacturing a gold-colored steel sheet according to the present invention is characterized not by applying titanium (Ti) by conventional physical or chemical vapor deposition but by forming a TiN modified layer by enriching titanium included in a steel composition from the inside to a surface of the steel sheet.

The method for manufacturing the gold-colored steel sheet according to an embodiment of the present invention, the TiN modified layer may be formed on a surface of a steel sheet including 0.3 to 1.5% by weight of titanium (Ti) by an annealing treatment in a nitrogen ($N_2$) atmosphere.

In the present invention, titanium (Ti) included in the steel is enriched in the surface and nitrided through the annealing treatment. The titanium sufficiently enriched in the surface layer is combined with activated nitrogen (N) diffused in the steel to form the TiN modified layer of a nitrided layer so that an attractive gold color on the surface of the steel can be expressed.

The method of manufacturing the gold-colored steel sheet according to an embodiment of the present invention may include 0.3 to 1.5 wt % of titanium (Ti) in a steel composition so that enrichment into the surface layer during the annealing treatment may be smooth. When the content of titanium (Ti) is less than 0.3 wt %, the enriching to the surface layer is not smooth and the formation of the TiN modified layer is difficult. When the content exceeds 1.5 wt %, the steelmaking capacity decreases.

FIG. 1 is a schematic diagram showing the behavior of titanium and nitrogen in normal steel. Generally, titanium (Ti) exhibits high reactivity with carbon (C) and nitrogen (N) included in steel, so it bonds with carbon or nitrogen during the annealing treatment and precipitates into TiC or TiN in a matrix. Titanium (Ti) having a higher carbide forming ability than chromium (Cr) prevents chromium deficiency by forming TiC and improves wear resistance by forming TiN. However, carbon and nitrogen included in the steel have a problem of precipitation of TiC or TiN during the enrichment of titanium, so it is necessary to control the content of carbon and nitrogen.

Accordingly, the method of manufacturing the gold-colored steel sheet according to an embodiment of the present invention may include 0.3 to 1.5 wt % of titanium (Ti) and 0.003 wt % or less of nitrogen (N). When the content of nitrogen (N) is more than 0.003 wt %, TiN precipitates during the annealing treatment to reduce the content of titanium enriched in the surface layer, so that it may be difficult to form the TiN modified layer.

The method of manufacturing the gold-colored steel sheet according to an embodiment of the present invention is characterized in that the sum of carbon (C) and nitrogen (N) contents (hereinafter, referred to as C+N) may be 0.015 wt % or less. When the content of C+N exceeds 0.015 wt %, precipitation of TiC and TiN is facilitated during the annealing heat treatment and the content of titanium (Ti) enriched in the surface layer is reduced. Therefore, the content of C+N is preferably 0.015 wt % or less.

FIG. 2 is a schematic diagram showing the behavior of titanium and nitrogen according to the present invention. Referring to FIG. 2, as the steel is heated to the recrystallization temperature or higher through the annealing treatment, titanium (Ti) can diffuse and move. Titanium has strong affinity with nitrogen and can bond with activated nitrogen (N) diffused into the steel to form the TiN modified layer. Since the activated nitrogen is consistently diffused into the steel, the titanium having a strong affinity is consistently enriched in the surface layer, and by bonding with the activated nitrogen, the TiN modified layer can be formed to a sufficient thickness.

The annealing treatment may be performed in a nitrogen ($N_2$) atmosphere. Since the penetration of nitrogen atoms (N) is essential for the formation of the TiN modified layer of titanium (Ti) enriched in the surface layer, the annealing treatment may be performed in a nitrogen ($N_2$) atmosphere.

Also, the annealing treatment may be a continuous bright annealing treatment in bright annealing line (BAL). Bright annealing is annealing performed in an oxygen-free atmosphere so that high-temperature oxides are not formed as compared with annealing pickling performed in an oxygen atmosphere. Accordingly, bright annealing is mainly used for architectural interiors and home appliances that can maintain its original gloss and require an aesthetic surface. By performing the bright annealing in a nitrogen ($N_2$)

atmosphere, the fraction of $TiO_2$ can be suppressed and the fraction of TiN can be maximized.

The annealing treatment may be performed in a furnace of a nitrogen ($N_2$) atmosphere at 900 to 1,200° C. for 30 to 300 seconds.

When the annealing treatment temperature is lower than 900° C., nitrogen molecules ($N_2$) are difficult to decompose into activated nitrogen (N) capable of reacting with titanium (Ti) enriched in a steel surface. When the annealing temperature exceeds 1,200° C., a grain size may become large. Therefore, the annealing treatment temperature range is suitably 900 to 1,200° C., and more preferably 950 to 1,150° C.

When the annealing time is shorter than 30 seconds, it is difficult to obtain a sufficient thickness of the TiN modified layer. If the annealing time is longer than 300 seconds, the grain size becomes large and the formability such as bending may be lowered. Therefore, the annealing treatment for 30 to 300 seconds is suitable, more preferably 30 to 100 seconds.

Activated nitrogen (N) can penetrate and diffuse into the surface layer of the steel sheet through the annealing treatment in the nitrogen ($N_2$) atmosphere.

Meanwhile, in order to diffuse the activated nitrogen (N) in the steel smoothly, an alloying component design that controls the content of trace elements that interfere with the penetration and diffusion of the activated nitrogen (N) may be accompanied. The penetration and diffusion of activated nitrogen (N) is easier as the nitrogen affinity of the alloying elements in the steel is larger. Therefore, it is more advantageous as the content of elements such as carbon (C), boron (B), silicon (Si), cobalt (Co), copper (Cu), tungsten (W), and molybdenum (Mo), which have relatively lower nitrogen affinity, is lower.

The TiN modified layer can be formed by the enrichment of titanium (Ti) in steel by the annealing treatment, and by the penetration and diffusion of activated nitrogen (N) generated at high temperature. Titanium enriched in the surface layer reacts with activated nitrogen to form TiN, and its thickness can be controlled by controlling the annealing temperature and time. In order to express a gold color on the surface of the steel, it is preferable that the thickness is at least 10 nm or more. In order to form a stable TiN modified layer such as improvement of hardness together with expression of the gold color, it is more preferable to form the layer with a thickness of 20 to 120 nm.

In the method of manufacturing the gold-colored steel sheet according to an embodiment of the present invention, the gold color can be expressed by forming the TiN modified layer on the steel surface. The TiN modified layer formed on the steel surface by the annealing treatment expresses the gold color due to its characteristics. In order to express an aesthetic gold color on the surface of the steel, the content of titanium (Ti) and nitrogen (N) in the TiN modified layer should be a certain level or more, the content of titanium should be preferably at least 30 wt % or more, and the content of nitrogen should be preferably at least 10 wt % or more. Also, the sum of the content of alloying elements other than titanium (Ti) and nitrogen (N) in the TiN modified layer can satisfy the following formula (1).

$$0.1\text{ wt }\% \leq C+Si+Al+Mn+Cr+Ni+Nb+Zr \leq 35.0\text{ wt }\% \quad (1)$$

The lower limit of formula (1) is based on the alloy composition of general low-alloy carbon steel or IF (Interstitial Free) steel. The general low-alloy carbon steel includes carbon (C) and nitrogen (N), and the IF steel may also include trace amounts of alloying elements in the TiN modified layer because titanium (Ti), niobium (Nb) and aluminum (Al) are used to remove carbon and nitrogen. Conversely, the upper limit of formula (1) may be a stainless steel including a large amount of alloying elements such as chromium (Cr) and nickel (Ni). When the sum of the alloying element contents in the TiN modified layer exceeds 35.0 wt %, the content of titanium (Ti) and nitrogen (N) is low and the gold color may be difficult to be expressed.

The TiN modified layer may exhibit high hardness due to the nature of the nitrided coating, and the pitting potential may be 300 mV or more. The pitting is corrosion where holes or puddles are formed in the surface of a passivated metal or alloy such as stainless steel, aluminum alloy or titanium. The pitting potential represents the resistance to the pitting of the surface.

FIG. 3 is a graph showing the corrosion resistance of the TiN modified layer. Referring to FIG. 3, due to the TiN modified layer, the steel sheet produced by the method of manufacturing the gold-colored steel sheet according to an embodiment of the present invention may have a pitting potential more than STS 304 steel, which is superior in corrosion resistance to sulfuric acid and corrosion resistance to salt water. That is, the TiN modified layer on the steel surface can provide excellent corrosion resistance to the steel sheet.

The steel sheet produced by the method of manufacturing the gold-colored steel sheet according to an embodiment of the present invention may have a b* value of 25 or more in the L*a*b* color system. The L*a*b* color system is the most popular color system in all fields to express the color of an object. L* represents brightness and a* and b* represent color and saturation respectively.

FIG. 4 is a schematic diagram of a COLOR SPACE showing the L*a*b* color system. Referring to FIG. 4, +a* represents a red direction, −a* represents a green direction, +b* represents a yellow direction, and −b* represents a blue direction, and as the larger the value, the clearer the color. In order to express an aesthetic gold color, the b* value indicating a yellow color should be high. To this end, the content of titanium (Ti) and nitrogen (N) in the TiN modified layer may be at least 30 wt % or more and 10 wt % or more respectively. It is preferable that the b* value of the L*a*b* color system is 27 or more in order to express a more aesthetic gold color.

Hereinafter, the present invention will be described in more detail with reference to examples.

EXAMPLES

A cold-rolled steel sheet 3 mm in thickness comprising 1.3 wt % of titanium (Ti) was subjected to a continuous bright annealing treatment for 60 seconds at 1100° C. in a furnace of a nitrogen atmosphere. After the annealing treatment, the chromaticity of the steel surface was measured by using ColorQuest XE (Hunter Lab/U.S.A.) equipment. Also, the surface of the steel sheet was polished with #600 sandpaper, and the pitting potential was measured using a 3.5% NaCl solution at room temperature. The results are shown in Table 1 below.

TABLE 1

| Sample | L*a*b* Color system b* value | TiN modified layer thickness (nm) | Pitting potential (mV) |
|---|---|---|---|
| Example 1 | 28.71 | 65 | 400 |
| Example 2 | 28.10 | 65 | 410 |

TABLE 1-continued

| Sample | L*a*b* Color system b* value | TiN modified layer thickness (nm) | Pitting potential (mV) |
|---|---|---|---|
| Example 3 | 29.24 | 65 | 420 |
| Example 4 | 34.42 | 75 | 700 |
| Example 5 | 33.88 | 70 | 600 |
| Example 6 | 34.66 | 75 | 700 |
| Comparative Example | 1.77 | 0 | 40 |

Referring to Table 1, a TiN modified layer having a thickness of 65 to 75 nm was obtained by conducting a bright annealing treatment at an annealing temperature of 1100° C. for 60 seconds. The steel sheet of Example 4 was photographed by using the FIB-TEM technique and is shown in FIG. 5. It was found that a TiN modified layer of about 75 nm was formed.

FIG. 6 is a graph showing the behavior of alloying elements according to the depth from the surface of the steel sheet of Example 1, wherein the contents of titanium and nitrogen are respectively 30 wt % or more and 10 wt % or more from the surface to about 60 nm and a sum of the contents of other alloying elements is 0.1 to 35.0 wt %. As a result, the composition of the intended TiN modified layer of the present invention was satisfied.

In the Comparative Example not subjected to the continuous bright annealing treatment according to the present invention, the b* value indicating yellow was 1.77 and the gold color was not expressed at all. Conversely, in each of Examples 1 to 6, the b* value was 28 or more and it was possible to express an aesthetic gold color.

Also, in all of Examples 1 to 6, the pitting potential was 400 mV or more, indicating excellent corrosion resistance.

While the present disclosure has been particularly described with reference to exemplary embodiments, it should be understood by those skilled in the art that various changes in form and details may be made without departing from the spirit and scope of the present disclosure.

INDUSTRIAL APPLICABILITY

The gold-colored steel sheet according to the embodiments of the present invention can be applied to applications such as an interior decoration pipe, a building interior/exterior material or a home appliance exterior material.

The invention claimed is:

1. A gold-colored steel sheet comprising a base material and a modified layer provided on an outermost surface layer of the base material, wherein the modified layer is a TiN modified layer comprising 30 wt % or more of Ti and 10 wt % or more of N, wherein the TiN modified layer has a thickness of 20 to 120 nm, and wherein alloy element contents in the TiN modified layer satisfy the following formula (1):

$$0.1\text{ wt }\% \leq C+Si+Al+Mn+Cr+Ni+Nb+Zr \leq 35.0\text{ wt }\% \quad (1)$$

here, C, Si, Al, Mn, Cr, Ni, Nb and Zr mean the content (wt %) of each element.

2. The gold-colored steel sheet according to claim 1, wherein a b* value of an L*a*b* color system of a surface of the TiN modified layer is 25 or more.

3. The gold-colored steel sheet according to claim 1, wherein the base material comprises 0.003 wt % or less of N and 0.015 wt % or less of C+N.

4. The gold-colored steel sheet according to claim 1, wherein the content of Ti in the TiN modified layer diffused from the base material thereby reducing the content of Ti in the base material.

5. The gold-colored steel sheet according to claim 4, wherein the TiN modified layer has a thickness of 65 to 75 nm.

6. The gold-colored steel sheet according to claim 1, wherein the gold-colored steel sheet has a pitting potential of 300 mV or more.

* * * * *